US008556137B2

(12) United States Patent
Vogel et al.

(10) Patent No.: US 8,556,137 B2
(45) Date of Patent: Oct. 15, 2013

(54) CLOSURE FOR A CONTAINER

(75) Inventors: William C. Vogel, Mequon, WI (US); Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 1271 days.

(21) Appl. No.: 12/391,121

(22) Filed: Feb. 23, 2009

(65) Prior Publication Data

US 2010/0213221 A1 Aug. 26, 2010

(51) Int. Cl.
*B67D 7/78* (2010.01)

(52) U.S. Cl.
USPC ..... 222/515; 222/143; 222/508; 222/546; 222/561

(58) Field of Classification Search
USPC ..... 222/505–509, 511–518, 544–563, 143
See application file for complete search history.

(56) References Cited

U.S. PATENT DOCUMENTS

| | | | | |
|---|---|---|---|---|
| 2,160,976 | A | 6/1939 | Mirati | |
| 2,187,927 | A * | 1/1940 | Rene | 222/470 |
| 2,274,849 | A | 3/1942 | Peterson | |
| 2,562,580 | A | 7/1951 | Satz et al. | |
| 2,670,107 | A | 2/1954 | Welden | |
| 3,794,235 | A | 2/1974 | Flider | |
| 3,845,872 | A | 11/1974 | Town et al. | |
| 3,850,350 | A | 11/1974 | Town et al. | |
| 4,099,642 | A * | 7/1978 | Nergard | 220/715 |
| 4,212,408 | A * | 7/1980 | Valenzona | 220/254.5 |
| 4,262,802 | A | 4/1981 | Laauwe | |
| 4,371,095 | A | 2/1983 | Montgomery et al. | |
| 4,607,768 | A | 8/1986 | Taber et al. | |
| 4,750,648 | A | 6/1988 | Krydiak | |
| 4,911,337 | A | 3/1990 | Rosenthal | |
| 5,083,672 | A | 1/1992 | Lewandowski | |
| 5,199,597 | A | 4/1993 | Gladish | |
| 5,205,402 | A | 4/1993 | Maeda | |
| RE34,263 | E | 5/1993 | vanKerkhoven et al. | |
| 5,242,093 | A * | 9/1993 | Worrell et al. | 222/470 |
| 5,246,126 | A | 9/1993 | Lewis, Jr. | |
| 5,273,177 | A | 12/1993 | Campbell | |
| 5,310,081 | A | 5/1994 | McCabe | |
| 5,356,025 | A | 10/1994 | Renault | |
| 5,551,607 | A | 9/1996 | DeJonge, Sr. et al. | |
| 5,647,498 | A | 7/1997 | Kaneko | |
| 5,735,438 | A | 4/1998 | Ostrowsky | |
| 5,746,338 | A | 5/1998 | Takahashi et al. | |
| 5,901,885 | A | 5/1999 | Iida | |
| 5,921,425 | A | 7/1999 | Markey | |
| 5,927,535 | A | 7/1999 | Goth | |
| 6,253,938 | B1 * | 7/2001 | Zaksenberg et al. | 215/237 |

(Continued)

*Primary Examiner* — Kevin P Shaver
*Assistant Examiner* — Melvin Cartagena
(74) *Attorney, Agent, or Firm* — Foley & Lardner LLP

(57) ABSTRACT

A closure is provided that is configured to fit over a mouth of a receptacle to form a container. The closure includes a body portion having an open bottom formed of a skirt that defines an outer periphery of the body portion and an end wall defining at least one dispensing aperture. The closure also includes a member supported at the end wall. The member has a flap configured for pivotal movement and a user interface configured for sliding movement. The sliding movement of the user interface causes the pivotal movement of the flap. The closure further includes a retaining member coupled to the body portion for securing the member to the body portion. The retaining member at least partially covers the flap and the user interface.

20 Claims, 6 Drawing Sheets

(56) References Cited

U.S. PATENT DOCUMENTS

| | | | | |
|---|---|---|---|---|
| 6,257,452 | B1 | 7/2001 | Allen | |
| D448,296 | S | 9/2001 | Bried et al. | |
| D448,668 | S | 10/2001 | Baerenwald et al. | |
| 6,352,166 | B1 | 3/2002 | Copeland | |
| 6,460,729 | B2 | 10/2002 | Beecroft | |
| 6,540,120 | B2 | 4/2003 | Lebowitz | |
| 6,742,666 | B1 | 6/2004 | Bried et al. | |
| 6,752,287 | B1 | 6/2004 | Lin | |
| 7,413,096 | B2 | 8/2008 | Morgan et al. | |
| 7,513,380 | B2 * | 4/2009 | Canedo | 220/230 |
| 2005/0029265 | A1 | 2/2005 | Morgan et al. | |
| 2005/0067417 | A1 | 3/2005 | Sanders et al. | |
| 2005/0269325 | A1 | 12/2005 | Belcastro | |
| 2006/0016834 | A1 | 1/2006 | Palm et al. | |
| 2006/0201945 | A1 | 9/2006 | Tedford | |
| 2006/0226149 | A1 | 10/2006 | Yang et al. | |
| 2006/0261068 | A1 | 11/2006 | Schmidtner et al. | |
| 2006/0283867 | A1 | 12/2006 | DiDato | |
| 2007/0029323 | A1 | 2/2007 | Yang et al. | |
| 2007/0119878 | A1 | 5/2007 | Naden | |
| 2007/0158350 | A1 | 7/2007 | Peuker et al. | |
| 2007/0170184 | A1 | 7/2007 | Canedo | |
| 2007/0246467 | A1 | 10/2007 | Kneer | |
| 2007/0278228 | A1 | 12/2007 | Wong | |
| 2008/0023477 | A1 | 1/2008 | Markert | |
| 2008/0073311 | A1 | 3/2008 | Jelich et al. | |
| 2008/0073342 | A1 | 3/2008 | Cai | |
| 2008/0073343 | A1 | 3/2008 | Shadrach et al. | |
| 2008/0078763 | A1 | 4/2008 | Auer | |
| 2008/0105696 | A1 | 5/2008 | Dart et al. | |

* cited by examiner

CLOSURE FOR A CONTAINER

BACKGROUND

The present disclosure relates generally to a closure for a container for storing and dispensing materials (e.g., a particulate matter, etc.). The present disclosure more specifically relates to a closure having a movable flap for enclosing one or more dispensing openings in the closure.

It is generally known to provide a cover or closure on a container used for storing and dispensing particulate matter (e.g., granulated, powdered, etc.) or other materials, particularly foodstuffs, seasonings, etc. such as those displayed and sold in supermarkets. Such a closure typically attaches to an open end of a receptacle and has at least one dispensing opening for dispensing the material retained with the receptacle. The closure may include a hinged flap associated with the at least one dispensing opening that is configured to selectively close or seal such an opening when the flap is moved to a closed position. If a flap is provided on such a closure, the flap is typically configured to be moved from the closed position to an open position by being directly engaged by a user (e.g., by being lifted by the hand of a user, etc.).

SUMMARY

One embodiment relates to a closure configured to fit over a mouth of a receptacle to form a container. The closure includes a body portion having an open bottom formed of a skirt that defines an outer periphery of the body portion and an end wall defining at least one dispensing aperture. The closure also includes a member supported at the end wall. The member has a flap configured for pivotal movement and a user interface configured for sliding movement. The sliding movement of the user interface causes the pivotal movement of the flap. The closure further includes a retaining member coupled to the body portion for securing the member to the body portion. The retaining member at least partially covers the flap and the user interface.

Another embodiment relates to a closure configured to fit over a mouth of a receptacle to form a container. The closure includes a body portion having an open bottom formed of a skirt that defines an outer periphery of the body portion and an end wall defining at least one dispensing aperture. The closure also includes a flap supported at the end wall and configured for pivotal movement between a first position in which the dispensing aperture is closed and a second position in which the dispensing aperture is open. The closure further includes a user interface coupled to the flap and slidable in a direction substantially parallel to the end wall for moving the flap between the first position and the second position. The user interface remains within the outer periphery of the body portion as the flap is moved between the first position and the second position.

Another embodiment relates to a closure configured to fit over a mouth of a receptacle to form a container. The closure includes a body portion having an open bottom formed of a skirt and an end wall defining a dispensing aperture. The closure also includes a flap supported at the end wall for pivotal movement between an open position and a closed position. The closure further includes a user interface coupled to the flap and supported at the end wall for slidable movement between a first position in which the flap is in the open position and a second position in which the flap is in the closed position. The closure further includes a retaining member disposed over the flap and the user interface and coupled to the end wall for securing the flap and the user interface relative to the body portion. The end wall defines a recess configured to receive the retaining member so that the retaining member is substantially uniform with the end wall.

DETAILED DESCRIPTION

Figure 1:
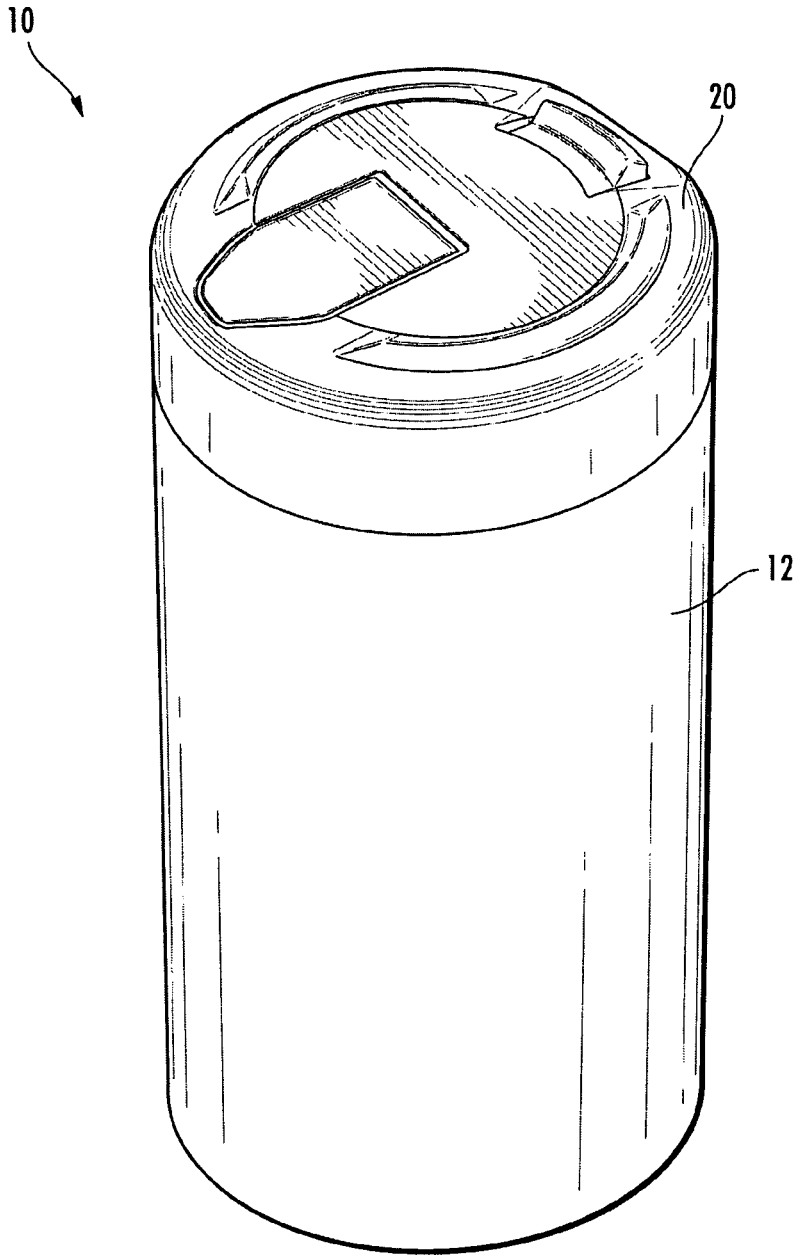
FIG. 1 is a perspective view of a container according to an exemplary embodiment.
Figure 2:
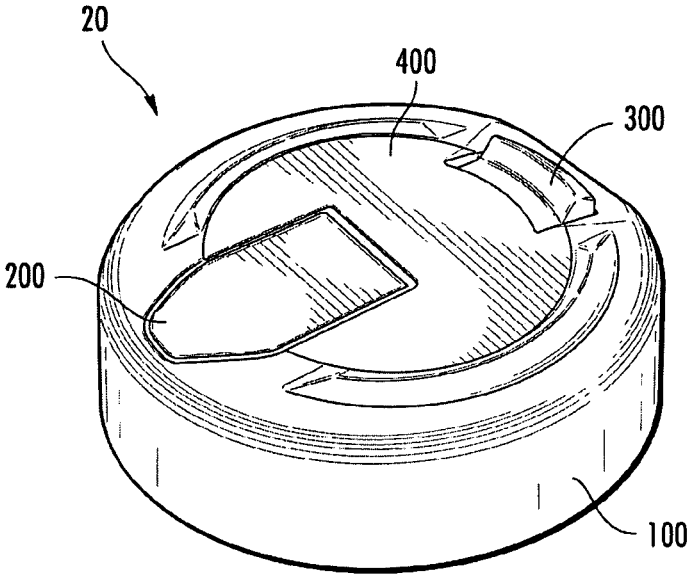
FIG. 2 is a perspective view of a closure from the container of FIG. 1 shown in a closed position.
Figure 3:
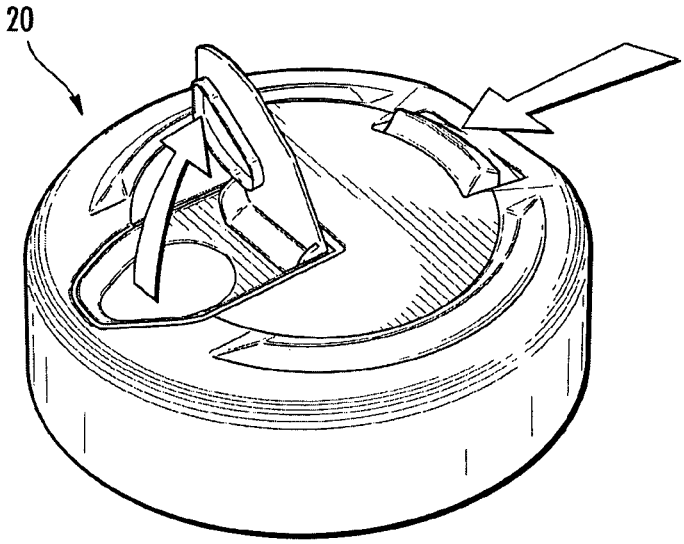
FIG. 3 is a perspective view of the closure of FIG. 2 shown in an open position.
Figure 4:
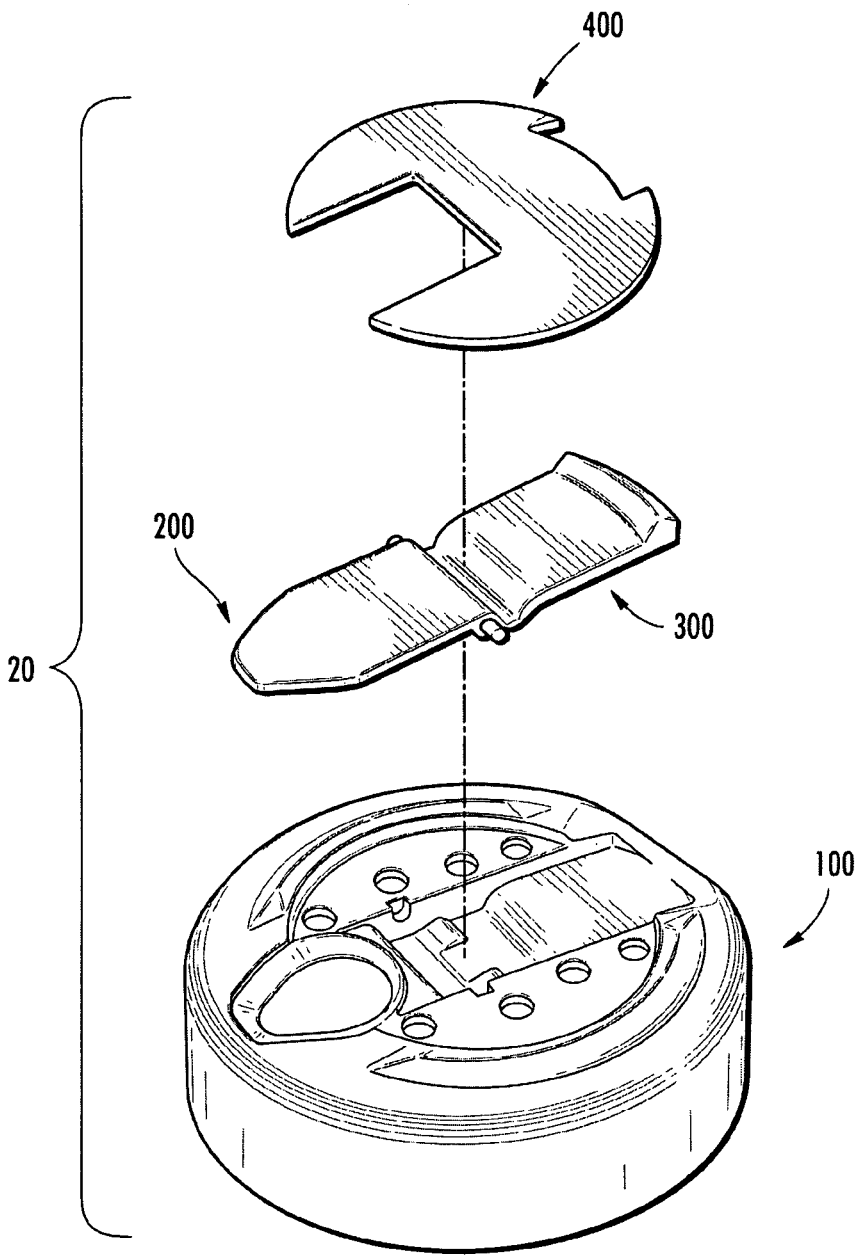
FIG. 4 is an exploded perspective view of the closure of FIG. 2.

Referring to the FIGURES in general, a closure, shown as a closure 20, for a container 10 is shown according to an exemplary embodiment. Closure 20 may be used for dispensing matter that is provided in conventional receptacle, shown as a receptacle 12. Such matter may include particulate food stuffs such as cheese, spices, powdered creamers, etc. or a variety of other matter (e.g., including liquid matter, solid matter, semi-solid matter, etc.) that is capable of being stored within receptacle 12 and that can be dispensed through an dispensing opening that may be provided in closure 20.

Referring to FIGS. 1 through 4, closure 20 is shown as generally including a body (e.g., base, etc.), shown as body portion 100, a cover (e.g., lid, etc.), shown as a flap 200, an actuating device, shown as a user interface 300, and an attachment member (e.g., locking member, etc.), shown as a retaining member 400. Closure 20 is configured to fit over a mouth of receptacle 12 to form container 10. Body portion 100 has an open bottom formed of a skirt that defines an outer periphery of the body portion and an end wall that defines at least one dispensing aperture. Flap 200 and user interface 300, which according to an exemplary embodiment may be integrally formed as a one-piece unitary body, are supported at the end wall. Flap 200 is configured for pivotal movement between closed position (shown in FIG. 2) and an open position (shown in FIG. 3). The sliding movement of user interface 300 causes the pivotal movement of flap 200 thereby allowing for an indirect opening of flap 200 by a user. Retaining member 400 is provided to secure flap 200 and user interface 300 to body portion 100.

Figure 5:
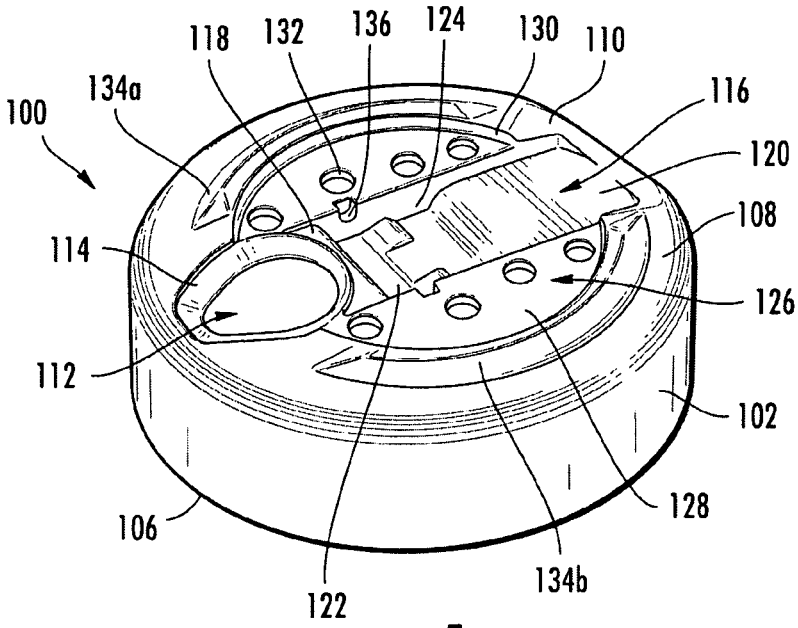
FIG. 5 is a top perspective view of a base portion of the closure of FIG. 2 shown according to an exemplary embodiment.
Figure 6:
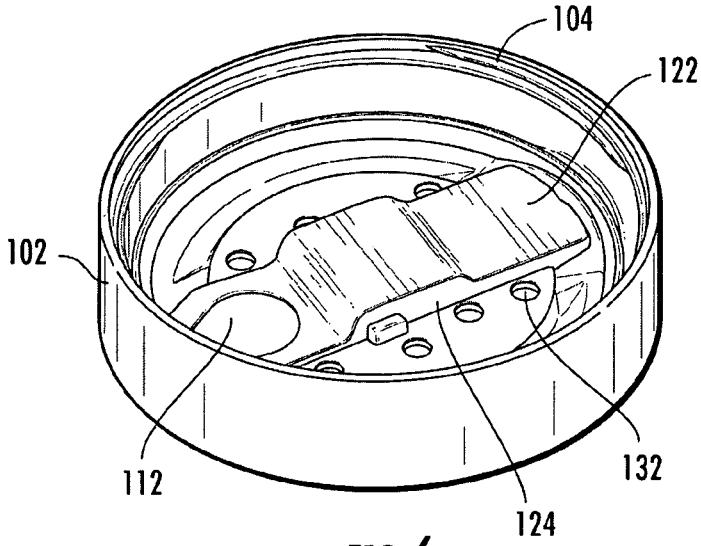
FIG. 6 is a bottom perspective view of the base portion of FIG. 5.
Figure 7:
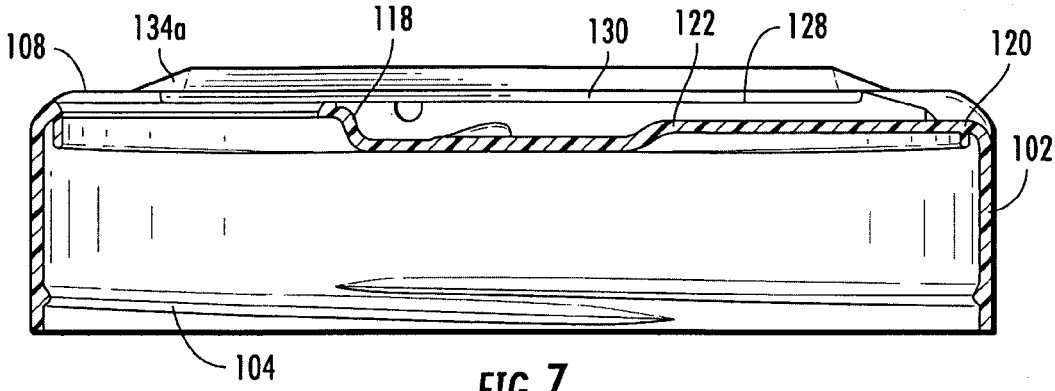
FIG. 7 is a cross sectional view of the base portion of FIG. 5.

Referring to FIGS. 5 through 7, body portion 100 of the closure 20 is shown according to an exemplary embodiment. Body portion 100 has a side wall 102 (e.g., skirt, etc.) adapted to fit over an end of receptacle 12. According to one exemplary embodiment, side wall 102 is cylindrical in shape and has a coupling component (e.g., attachment structure), shown as threads 104, located on an inside surface for engaging a corresponding coupling component (e.g., threads, etc.) on receptacle 12 to secure closure 20 to the open end of receptacle 12. According to the various alternative embodiments, the coupling component may be any known or otherwise suitable structure (e.g., press-on rings or snap-fit structure, ribs, etc.) for coupling closure 20 to receptacle 12.

Side wall 102 extends continuously in a substantially vertically direction between a bottom edge 106 (e.g., a free end, etc.) of side wall 102 and an end wall 108 of body portion 100. According to the embodiment illustrated, side wall 102 is slightly tapered such that the diameter of side wall 102 near the top of body portion 100 is slightly smaller than the diameter of side wall 102 near the bottom of body portion 100. This slight taper (which may be as small as several thousandths) is intended to reduce the potential for interference with machinery that may be used to couple closure 20 to receptacle 12.

Side wall 102 also comprises a depression or indentation 110. Indentation 110 is configured to cooperate with a corresponding depression or indentation provided on end wall 108 to receive a thumb, finger, etc. of a user for facilitating the movement of user interface 300 and the opening of flap 200 from the closed position. According to an exemplary embodiment, indentation 110 is substantially concave (e.g., semicircular, etc.) and has a surface that is angled slightly downward to further simplify access to user interface 300 for a user. According to the various alternative embodiments, indentation 110 may be provided in any of a number of forms (e.g., planar surfaces, convex surfaces, curvilinear surfaces, etc.) or may be eliminated entirely if it is determined that a user can adequately actuate user interface 300 without providing additional clearance in side wall 102.

According to an exemplary embodiment, the thickness of side wall 102 remains substantially constant from the top end (e.g., the end of side wall 102 closest to end wall 108) to the bottom end 106 (e.g., the end of side wall 102 opposite the top end) of side wall 102. According to the various alternative embodiments, the thickness of the side wall 102 may reduce as side wall 102 extends from the top end to the bottom end such that the thickness of side wall 102 near its bottom end is less than the thickness of side wall 102 near its top end. The reduction in the thickness of side wall 102 as it extends away from end wall 108 may reduce the extent to which body portion 100 takes a noncircular or oval shape when it is removed from the mold. According to other alternative embodiments, the thickness of side wall 102 may increase as it extends away from end wall 108 or may otherwise vary along the height of side wall 102.

Body portion 100 also includes end wall 108 which is shown as being oriented substantially perpendicular to a central axis of side wall 102. According to an exemplary embodiment, end wall 108 and side wall 102 are integrally formed as a single unitary body in a single mold by an injection molding operation to form body portion 100. According to the various alternative embodiments, end wall 108 and side wall 102 may be formed separately and may be coupled together in any known or otherwise suitable manner (e.g., snap-fit, adhesive, welding, etc.).

End wall 108 defines at least one shaker opening 112 (shown as a single tear-drop shaped opening). According to an exemplary embodiment, shaker opening 112 is provided on a side of body portion 100 opposite indentation 110 with the narrow portion of the tear-drop shape being arranged adjacent to side wall 102. According to the embodiment illustrated, shaker opening 112 includes a peripheral edge recess 114 that may provide an area of reduced thickness (relative to other portions of end wall 108) surrounding shaker opening 112 and is configured to receive a portion of flap 200. The area of reduced thickness is intended to provide a relatively thin, flexible region around shaker opening 112 to facilitate the sealing and retention features provided by the interface between shaker opening 112 and flap 200. According to the embodiment illustrated, peripheral edge recess 114 is slanted downward and inward towards shaker opening 112. Such a configuration may allow any material being dispensed from receptacle 12 to fail back into receptacle 12 if left on peripheral edge recess 114. Such a configuration may also provide guidance for the portion of flap 200 that is configured to engage shaker opening 112.

According to an exemplary embodiment, peripheral edge recess 114 is sized (e.g., has a depth, etc.) so that flap 200 can be substantially coplanar or flush with end wall 108 when in the closed position. Such a configuration advantageously provides closure 20 with a more uniform appearance when flap 200 is in the closed position and/or may reduce the likelihood that flap 200 will be inadvertently opened by having an object (e.g., a finger, another container, etc.) catch on flap 200 and move it upward. According to the various alternative embodiments, shaker opening 112 may have any suitable shape, size, number and pattern to suit the desired application and material to be dispensed from the container. For example, end wall 108 may include two or more shaker openings 112, and each shaker opening 112 may have a shape and size that is suitable to the application in which the closure will be used. For example, shaker opening 112 may be circular, rectangular, football-shaped, half moon-shaped, or one of a variety of other shapes.

End wall 108 also defines a recess, shown as a channel 116 for receiving and supporting flap 200 and user interface 300. Channel 116 is sized and configured so that flap 200 and user interface 300 can be recessed within end wall 108. According to an exemplary embodiment, channel 116 is a substantially rectangular channel located in a central region of end wall 108. Channel 116 extends between a first end 118 that terminates at shaker opening 112 and a second end 120 that terminates at indentation 110. According to the embodiment illustrated, channel 116 has a width that is substantially equal to the width of flap 200 and user interface 300, which is also substantially equal to the width of shaker opening 112. Channel 116 is defined by a bottom wall 122 and a pair of side walls 124. Bottom wall 122 varies in depth and orientation as channel 116 extends between first end 118 and second end 120. For example, an area of channel 116 configured to receive the transition region between flap 200 and user interface 300 (e.g., an area centrally located on end wall 108, etc.), has a greater depth than an area near first end 118 and an area near second end 120. The area of increased depth may provide clearance for the movement of flap 200 and user interface 300.

End wall 108 also defines a recess 126 for receiving retaining member 400. According to an exemplary embodiment, recess 126 has a shape corresponding to the shape of retaining member 400 and a depth that allows a top surface of retaining member 400 to be substantially coplanar or flush with end wall 108 and flap 200 when retaining member 400 is secured to body portion 100. Such a configuration advantageously provides closure 20 with a more uniform appearance. Recess 126 is defined by a bottom wall 128 and a side wall 130 which is substantially perpendicular to bottom wall 128. According to the embodiment illustrated, recess 126 has a substantially circular shape and is centrally located relative to end wall 108. As shown, recess 126 is not continuous across end wall 108, but rather is interrupted by channel 116 and shaker opening 112. According to the various alternative embodiments, recess 126 may take any one of a plurality of different shapes (e.g., square, triangular, oval, rectangular, trapezoidal, tear-drop shaped, football shaped, etc.) depending on the shape of retaining member 400.

Bottom wall 128 of recess 126 defines a receiving structure, shown as a plurality of coupling apertures 132, located around channel 116 in end wall 108. According to an exemplary embodiment, coupling apertures 132 are circular and have a diameter on the top side of bottom wall 128 that is greater than the diameter on the bottom side of bottom wall 128 to create a receiving profile (e.g., funnel-shape, cone, wedge, countersink, taper, etc.) to receive the corresponding coupling structure provided on retaining member 400. According to the embodiment illustrated, eight coupling apertures 132 are provided—four on a first lateral side of channel 116 and four on a second lateral side of channel 116. According to the various alternative embodiments, any number of coupling apertures 132 may be provided in bottom wall 128 to correspond to the coupling structure of retaining member 400. According to other alternative embodiments, coupling apertures 132 may take any one of a plurality of different shapes (e.g., square, triangular, oval, rectangular, trapezoidal, tear-drop shaped, football shaped, etc.). According to further alternative embodiments, coupling apertures 132 may be provided outside of recess and anywhere along end wall 108. According to still further alternative embodiments, the receiving structure may include pegs, projections, or other types of suitable coupling structures that are configured to cooperate with corresponding structure or structures provided on retaining member 400.

End wall 108 further includes one or more projections (e.g., raised skirts, stacking lips, nesting rings, etc.), shown as rims 134*a* and 134*b*, that extend at least partially around end wall 108. Rims 134*a* and 134*b* are provided so that a bottom surface of a receptacle a container that is stacked on top of closure 20 may be supported directly on end wall 108 such that rims 134*a* and 134*b* restrain the receptacle from significant lateral movement. According to the embodiment illustrated, rims 134*a* and 134*b* are offset inwardly from side wall 102 and are shaped to substantially correspond to the shape of side wall 102. Rim 134*a* is shown as extending between indentation 110 and shaker opening 112 on a first lateral side of channel 116, while rim 134*b* is shown as extending between indentation 110 and shaker opening 112 on an opposite second lateral side of channel 116. According to an exemplary embodiment, an inside edge of rims 134*a* and 134*b* is substantially adjacent to side wall 130 of recess 126. Each of rims 134*a* and 134*b* are shown as having a substantially triangular cross-section. The height and width of rims 134*a* and 134*b* may vary depending on how the bottom of the receptacle is shaped. According to the various alternative embodiments, the cross-sectional shape of rims 134*a* and 134*b* may be any known or otherwise suitable shape (e.g., rectangular, trapezoidal, rounded, L-shaped, etc.). According to other alternative embodiments, the height and width of rims 134*a* and 134*b* may be provided in any suitable range such as, for example, a height and a width that causes the bottom of a stacked container to be lifted or elevated above the end wall 108 of body portion 110.

Figure 8:
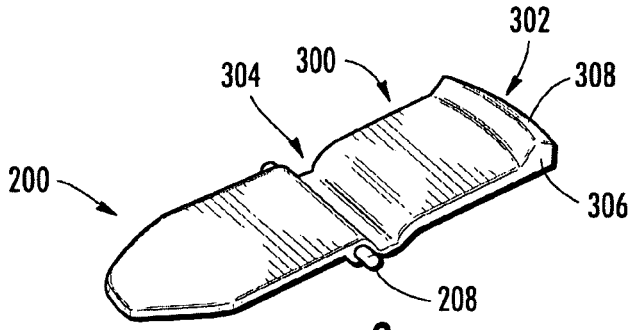
FIG. 8 is a top perspective view of a flap and a user interface of the closure of FIG. 2 shown according to an exemplary embodiment as a one-piece unitary member.
Figure 9:
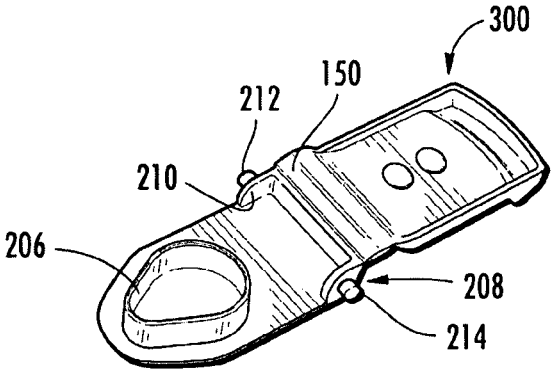
FIG. 9 is a bottom perspective view of the flap and the user interface of FIG. 8.
Figure 10:
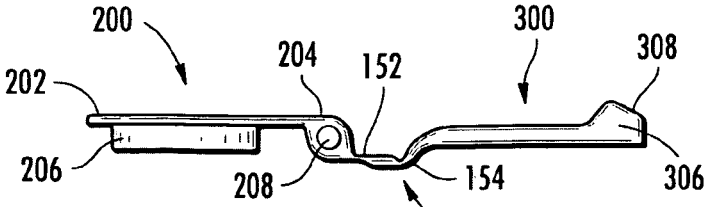
FIG. 10 is a side view of the flap and the user interface of FIG. 8.

Referring to FIGS. 8 through 10, flap 200 of closure 20 is shown according to an exemplary embodiment. Flap 200 is supported by body portion 100 and is configured to be selectively moved between a first or closed position in which shaker opening 112 is closed (e.g., concealed, at least partially concealed, etc.) and a second or open position in which shaker opening 112 is open (e.g., exposed, at least partially exposed, etc.). According to an exemplary embodiment, flap 200 is configured for pivotal movement between the closed position and the open position.

Flap 200 is shown as a substantially flat and rectangular member having a first end 202 that is configured to cover shaker opening 112 and a second end 204 that provides for the pivotal movement of flap 200. The width of flap 200 corresponds approximately to the width of channel 116 so that when flap 200 is supported at body portion 100, flap 200 and end wall 108 of body portion 100 provide a smooth and uniform appearance.

According to an exemplary embodiment, first end 202 of flap 200 is tapered and does not extend past side wall 102 when moved to the closed position. Flap 200 has a projection 206 (e.g., clean-out rings, etc.) extending perpendicularly downward from an underside of first end 202 of flap 200 and corresponding to shaker opening 112. According to the embodiment illustrated, projection 206 has a tear-drop shape and is sized slightly smaller than shaker opening 112. According to the various alternative embodiments, projection 206 may be the same size or slightly larger than shaker opening 112 so that projection 206 will frictionally engage shaker opening 112 when flap 200 is moved to a closed position.

According to an exemplary embodiment, projection 206 has a substantially rectangular cross-section. According to the various alternative embodiments, the lower, outside edge (or a portion of the edge) of projection 206 may be relieved (e.g., radiused, angled, sloped, chamfered, beveled, etc.) to facilitate entry of projection 206 in shaker opening 112. The extension of projection 206 into shaker opening 112 tends to reduce the likelihood of sifting or other leakage of material in the receptacle out from beneath flap 200 when flap 200 is in the closed position. According to an exemplary embodiment, the length of projection 206 is sufficient to allow the end of projection 206 to at least extend through shaker opening 112. According to the various alternative embodiments, the length of projection 206 may be sufficient to allow projection 206 to extend only a portion of the way through shaker opening 112. By adjusting the length and/or size of projection 206, the amount of force required to fully close (and open) shaker flap 200 can be adjusted or modified as desired.

Provided at second end 204 of flap 200 is a pivot rod or shaft 208 that defines an axis about which flap 200 is configured to pivot when moving between the closed position and the open position. To support pivot shaft 208, flap 200 includes a side wall 210 at each lateral side of second end 204. According to the embodiment illustrated, pivot shaft 208 includes a first projection 212 extending outward from side wall 210 at a first lateral side of flap 200 and a second projection 214 extending outward from side wall 210 at an opposite second lateral side of flap 200. First projection 212 and second projection 214 are configured to between received within recesses defined by end wall 108 of body portion 100. For example, first projection 212 and second projection 214 are received with recesses 136 (shown in FIG. 5) defined by bottom wall 128 of recess 126 and side walls 124 of channel 116. According to the embodiment illustrated, first projection 212 and second projection 214 each have a substantially circular cross section, but alternatively, may have any of a number of cross sectional shapes that will permit the pivotal movement of flap 200.

Still referring to FIGS. 8 through 10, user interface 300 is shown according to an exemplary embodiment. As detailed above, flap 200 is configured for pivotal movement between the closed position and the open position. To move flap 200 from the closed position to the open position, flap 200 is not intended to be directly engaged by a user, but rather, is configured to be indirectly engaged by a user. It has been discovered that flap 200 may be easier for a user to open through indirect engagement rather than direct engagement. To facilitate the indirect opening of flap 200, user interface 300 is provided. A user directly engages or otherwise manipulates user interface 300 to move flap 200 between the closed position and the open position.

According to an exemplary embodiment, user interface 300 is supported by body portion 100 and is configured to be selectively moved between a first position in which flap 200 is in the closed position and a second position in which flap 200 is pivoted upward and is in the open position. According to the embodiment illustrated, user interface 300 is configured for sliding movement between the first position and the second position. Further, user interface 300 is configured to slide towards shaker opening 112 (e.g., towards a central portion of body portion 100, etc.) to open flap 200 and to slide away from shaker opening 112 (e.g., towards side wall 102, etc.) to close flap 200.

User interface 300 is shown as a substantially flat and rectangular member having a first end 302 that is configured to be engaged or otherwise manipulated by a user and a second end 304 that is configured to be directly or indirectly coupled to flap 200. The width of user interface 300 corresponds approximately to the width of channel and flap 200 so that when user interface 300 is supported at body portion 100, user interface 300 and end wall 108 of body portion 100 provide a smooth and uniform appearance.

According to an exemplary embodiment, first end 302 of user interface 300 does not extend past side wall 102 when moved between the first position and the second position. First end 302 has a projection 306 extending downward from a top surface of first end 302. Projection 306 is configured to be engaged by the user and includes an angled surface 308 to further facilitate engagement. Angled surface 308 may include indicia or a marking to provide guidance to a user that this is the portion of user interface 300 that should be engaged to open flap 200. Angled surface 308 may also be textured (e.g., include a plurality of spaced apart ribs, etc.) to provide a frictional engagement between the user and user interface 300 (e.g., to ensure a positive engagement between the user and user interface 300, etc.).

According to an exemplary embodiment, flap 200 and user interface 300 are integrally-formed as a single unitary body. In such an embodiment, a transition area or central region 150 (e.g., web, panel, bridge, strip, etc.) is provided between flap 200 and user interface 300. Central region 150 provides a structure for joining flap 200 and user interface 300. According to the embodiment illustrated, central region 150 includes a first end 152 that is coupled to a lower edge of a rear wall 216 of flap 200 and a second end 154 that is coupled to a lower edge of second end 304 of user interface 300. Provided at first end 152 is a hinge (e.g., a living hinge, etc.) that allows flap 200 to pivot relative to central portion 150 and user interface 300. The hinge may be defined by an area of reduced thickness (e.g., slot, cut away, recess, crevice, channel, etc.) or formed using any suitable technique.

According to the embodiment illustrated, central portion 150 is orientated lower than flap 200 and user interface 300. To accommodate the lower orientation of central portion 150, channel 116 includes the area of increased depth. Central portion 150 is lower so that flap 200 can fold back over central portion 150 when flap 200 is pivoted to the open position. For this reason, the length of central portion 150 is substantially equal to the height of rear wall 216 (e.g., the portion of flap 200 that folds back over central portion 150, etc.).

Figure 11:
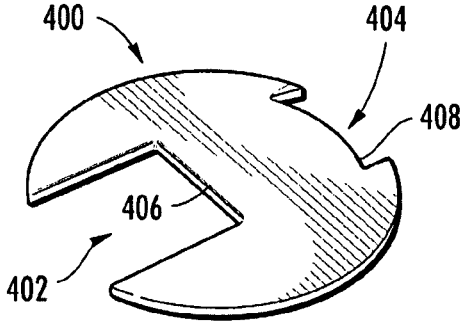
FIG. 11 is a top perspective view of a retaining member of the closure of FIG. 2.
Figure 12:
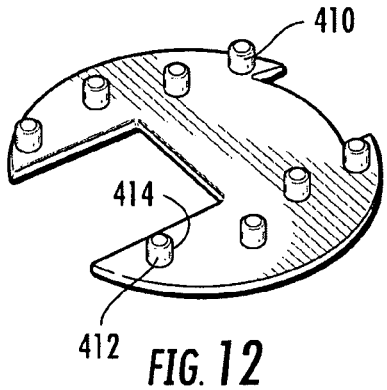
FIG. 12 is a bottom perspective view of the retaining member of FIG. 11.

Referring to FIGS. 11 and 12, retaining member 400 is shown according to an exemplary embodiment. Retaining member 400 is configured to be coupled to body portion 100 for securing flap 200 and user interface 300 relative thereto. Retaining member 400 secures flap 200 and user interface 300 relative to body portion 100 by being positioned at least partially over flap 200 and user interface 300. In such a configuration, flap 200 and user interface 300 are captured (e.g., trapped, sandwiched, etc.) between end wall 108 of body portion 100 and retaining member 400. Retaining member 400 captures flap 200 and user interface 300 in such a manner that permits flap 200 to pivot between the closed position and the open position and that permits user interface 300 to slide between the first position and the second position.

According to an exemplary embodiment, retaining member 400 is a substantially circular member configured to be received by recess defined in end wall 108 of body portion 100. Retaining member 400 has a thickness that allows retaining member 400 to be substantially flush with end wall 108 when coupled to body portion 100. According to the embodiment illustrated, retaining member 400 is configured to conceal or cover central portion 150. When flap 200 is in the closed position, retaining member 400 cooperates with end wall 108, flap 200 and user interface 300 to provide a substantially continuous and smooth top surface for closure 100.

Retaining member 400 is shown as including a first cutout area 402 configured to receive flap 200, and a second cutout area 404 configured to receive user interface 300. First cutout area 402 includes a rear wall 406 that is substantially straight and which is configured to engage a top surface of flap 200 when flap 200 is pivoted to the open position. Second cutout area 404 includes a rear wall 408 that substantially convex and which is configured to engage a back surface of projection 306 when user interface 300 is moved to the second position. According to the various alternative embodiments, rear wall 406 and rear wall 408 may have any of a number of shapes depending on the configurations of flap 200 and user interface 300.

To facilitate the coupling of retaining member 400 to body portion 100, retaining member 400 includes an engaging structure (e.g., coupling member, attachment device, etc.), shown as a plurality of projections 410 (e.g., legs, tubes, plugs, etc.), extending from an underside of retaining member 400. According to an exemplary embodiment, retaining member 400 includes eight projections 410. Projections 410 are each shown having a cylindrical base 412 and a lower, outer ridge 414 (e.g., rib, collar, barb, etc.). Projections 410 are configured to extend into coupling apertures 132 such that ridges 414 engage the lower surface of end wall 108 or lower corner of coupling apertures 132 to retain retaining member 400 in a coupled relationship with body portion 100. According to the various exemplary embodiments, projections 410 may take any one of a plurality of different shapes (e.g., square, triangular, oval, rectangular, trapezoidal, tear-drop shaped, football shaped, etc.) and be provided in different numbers to correspond to the receiving structure provided within end wall 108.

According to an exemplary embodiment, base portion 100, flap 200, user interface 300 and retaining member 400 may be formed in separate molds and then joined to form closure 20 by a suitable assembly procedure. According to an exemplary embodiment, flap 200 and user interface 300 are integrally formed to provide a one-piece unitary member. To assemble closure 20 for such a configuration, the one-piece unitary member is arranged on body portion 100 such that first projection 212 and second projection 214 of pivot shaft 208 are received by recesses 136 with flap 200 being positioned over shaker opening 112. With the one-piece unitary member in such a position, retaining member 400 can be attached to body portion 100 by aligning and engaging projections 410 with coupling apertures 132. Once retaining member 400 is attached, the one-piece unitary body is captured between body portion 100 and retaining member 400 in a manner that secures the one-piece unitary member to body portion 100 but still allows for the pivotal movement of flap 200 and the sliding movement of user interface 300.

Figure 13:
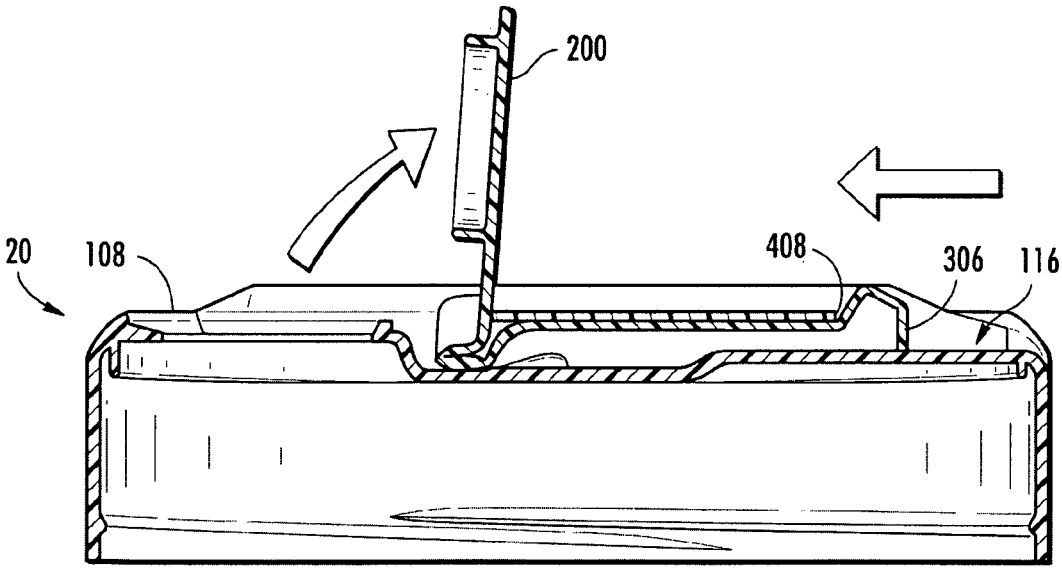
FIG. 13 is a cross sectional view of the closure as shown in FIG. 3.
Figure 14:
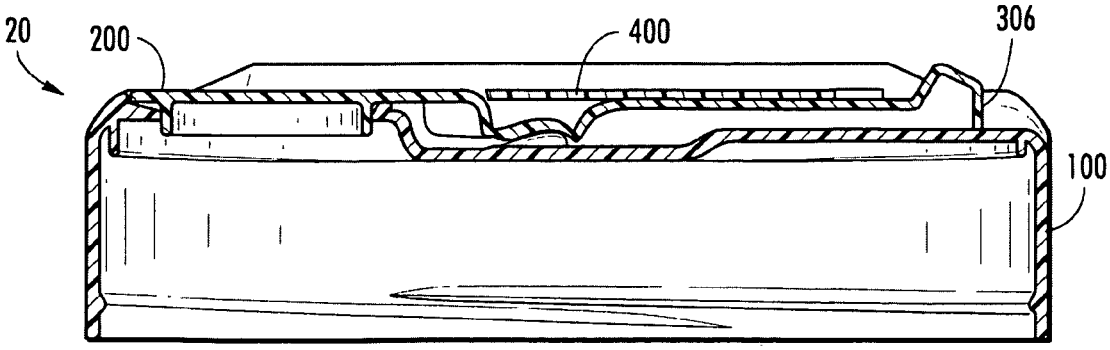
FIG. 14 is a cross sectional view of the closure as shown in FIG. 2.

Referring to FIGS. 13 and 14, the operation of closure 20 between the closed position and the open position will be described. To move flap 200 from the closed position (shown in FIG. 14) to the open position (shown in FIG. 13), a user applies a force on projection 306 of user interface 300. Optimally, the force applied by the user is in a direction towards the center of closure 20 and somewhat parallel to end wall 108. The user may apply such a force directly (e.g., by using a thumb, finger, etc.) or indirectly (e.g., by using a manipulation device or tool, etc.). The force applied by the user causes user interface 300 to slide within channel 116 towards the center of closure 20. As user interface 300 slides towards the center of closure 20, flap 200 begins to pivot about pivot shaft 208. As flap 200 pivots about pivot shaft 208, flap 200 also folds back over central region 150 the one-piece unitary member by rotating about hinge 156. According to an exemplary embodiment, user interface 300 can slide towards the center of closure 20 until projection 306 engages rear wall 408 of second cutout area 404. According to the embodiment illustrated, flap 200 has been rotated approximately 90 degrees relative to end wall 108 when projection 306 engages rear wall 408. According to the various alternative embodiments, flap 200 may be provided at any angle relative to end wall 108 when projection 306 engages rear wall 408. According to other alternative embodiments, the angular displacement of flap 200 may be controlled by a structure other than projection 306 engaging rear wall 408. For example, a stop mechanism or tab may be provided on end wall 108 to limit the movement of flap 200. To return flap 200 to the closed position, the user can either directly push downward on flap 200 or may slide user interface 300 in the opposite direction until flap 200 is returned to the closed position.

It is important to note that the construction and arrangement of the elements of the closure for a container provided in this specification are illustrative only. Although only a few exemplary and alternative embodiments of the present invention have been described in detail in this disclosure, those skilled in the art who review this disclosure will readily appreciate that many modifications are possible in these embodiments (such as variations in features such as orientation of flaps, skirts and corresponding recesses; variations in sizes, structures, shapes, dimensions and proportions of the flaps, recesses, projections, skirts, stiffeners and other elements; variations in the flap hinge arrangements, number of flaps, configuration and operation of flap closure structures and systems, arrangement and proportioning of spoon and shaker openings, use of materials, colors, combinations of shapes, etc.) without materially departing from the novel teachings and advantages of the invention. For example, the closure may be adapted and sized for use on any type of receptacle, or for use on receptacles of different sizes, and/or the closure may be used for dispensing a variety of different materials or contents. The body portion may be adapted for use on a receptacle with a square, rectangular, or other shaped mouth or opening, or the shaker opening may be replaced with more than one opening (e.g., a tear-drop, triangular, rectangular, circular, oval, or other shaped openings) and be configured to pour one or more of a variety of different materials. According to other alternative embodiments, the closure may be adapted for coupling to a receptacle by a threaded interface or by a snap-on ring or other press-fit engagement structure. According to other alternative embodiments, the flap and the user interface may be formed as separate members. It is readily apparent that each of the different embodiments and elements of the closure may be provided in a wide variety of shapes, sizes, thicknesses, combinations, etc. It is also readily apparent that the interfaces and structures for sealing and/or retaining the flap may be designed with any profile and configuration suitable for securing the flap to the body portion. Accordingly, all such modifications are intended to be within the scope of the inventions as defined in any appended claims.

The order or sequence of any process or method steps may be varied or re-sequenced according to alternative embodiments. In any claims, any means-plus-function clause is intended to cover the structures described herein as performing the recited function and not only structural equivalents but also equivalent structures. Other substitutions, modifications, changes and omissions may be made in the design, operating configuration and arrangement of the exemplary and other alternative embodiments without departing from the spirit of the present inventions as expressed in any appended claims.

What is claimed is:

1. A closure configured to fit over a mouth of a receptacle to form a container, the closure comprising:

a body portion having an open bottom formed of a skirt that defines an outer periphery of the body portion and an end wall defining at least one dispensing aperture, the end wall including at least one raised rim configured to facilitate stacking of a bottom of another receptacle atop the closure;

a member supported at the end wall, the member having a flap with a pivot rod defining a pivot axis substantially parallel to the end wall and configured for pivotal movement of the flap about the pivot axis and a user interface configured for sliding movement, the user interface coupled to the flap at a transition area having a hinge defining a hinge axis that is parallel to and offset from the pivot axis, so that the sliding movement of the user interface flexes the member about the hinge axis, causing the pivotal movement of the flap about the pivot axis between an open position and a closed position, the user interface including a projection configured to be engaged by a user, the projection circumferentially coextensive with the raised rim when in the closed position to facilitate stacking of the bottom of another receptacle atop the closure; and a retaining member coupled to the body portion for securing the member to the body portion, the retaining member at least partially covering the flap and the user interface.

2. The closure of claim 1 wherein the retaining member includes a first coupling structure corresponding to a second coupling structure provided on the end wall.

3. The closure of claim 2 wherein the first coupling structure comprises a plurality of projections and the second coupling structure comprises a plurality of apertures configured to receive the projections.

4. The closure of claim 1 wherein the end wall includes a channel configured to receive the member, the channel having a recess proximate the transition area of the member to accommodate rotational movement of the hinge about the pivot axis, the hinge and the recess being covered by the retaining member.

5. The closure of claim 4 wherein the hinge moves beneath a plane of the pivot axis so that the flap pivots above the plane of the pivot axis relative to the body portion, the pivot shaft being covered by the retaining member.

6. A container comprising the closure recited in claim 1 and a receptacle.

7. A closure configured to fit over a mouth of a receptacle to form a container, the closure comprising:

a body portion having an open bottom formed of a skirt that defines an outer periphery of the body portion and an end wall defining at least one dispensing aperture, the end wall including at least one raised rim configured to facilitate stacking of a bottom of another receptacle atop the closure;

a flap supported at the end wall by a pivot connection defining a pivot axis and configured for pivotal movement about the pivot axis between a first position in which the dispensing aperture is closed and a second position in which the dispensing aperture is open; and a user interface coupled to the flap at a transition area by a hinge defining a hinge axis substantially parallel to and offset from the pivot axis, the user interface slidable in a direction substantially parallel to the end wall and perpendicular to the hinge axis for moving the flap between the first position and the second position, the user interface including a projection configured to be engaged by a user, the projection circumferentially coextensive with the raised rim when in the first position to facilitate stacking of the bottom of another receptacle atop the closure;

wherein the user interface remains within the outer periphery of the body portion as the flap is moved between the first position and the second position.

8. The closure of claim 7 further comprising a retaining member coupled to the end wall for securing the flap and the user interface to the body portion.

9. The closure of claim 7 wherein the flap and the user interface are integrally-formed as a single unitary body.

10. The closure of claim 9 wherein the end wall defines a channel configured to receive the flap and the user interface.

11. The closure of claim 10 wherein the hinge moves rotationally beneath the pivot axis as the flap is moves between the first and second positions.

12. The closure of claim 11 wherein the channel has a depth that is greater under an area that receives the hinge than under an area that receives the user interface.

13. The closure of claim 11 wherein the single unitary body further comprises a pivot shaft defining the pivot axis about which the flap is configured to pivot.

14. The closure of claim 13 wherein the end wall defines a recess that receives the pivot shaft.

15. The closure of claim 7 wherein the user interface slides towards the dispensing aperture to move the flap to the second position and away from the dispensing aperture to move the flap to the first position.

16. The closure of claim 7 wherein the flap includes a clean out projection extending from a bottom surface of the flap, the clean out projection being configured to engage a peripheral edge of the end wall that defines the at least one dispensing aperture.

17. A closure configured to fit over a mouth of a receptacle to form a container, the closure comprising:

a body portion having an open bottom formed of a skirt and an end wall defining a dispensing aperture, the end wall including at least one raised rim configured to facilitate stacking of a bottom of another receptacle atop the closure;

a flap supported at the end wall by a pivot connection defining a pivot axis for pivotal movement between an open position and a closed position;

a user interface coupled to the flap by a hinge defining a hinge axis substantially parallel to and offset from the pivot axis and supported at the end wall for slidable movement between a first position in which the flap is in the open position and a second position in which the flap is in the closed position, the user interface including a projection configured to be engaged by a user, the projection circumferentially coextensive with the raised rim when in the closed position to facilitate stacking of the bottom of another receptacle atop the closure; and a retaining member disposed over the flap and the user interface and coupled to the end wall for securing the flap and the user interface relative to the body portion, wherein the end wall defines a recess configured to receive the retaining member so that the retaining member is substantially uniform with the end wall.

18. The closure of claim 17 wherein the retaining member includes a first cutout configured to receive the flap and a second cutout configured to receive the user interface.

19. The closure of claim 17 wherein the flap and the user interface are integrally-formed as a single unitary body that flex relative to each other about the hinge.

20. The closure of claim 17 wherein the sliding movement of the user interface is in a direction that is substantially parallel to the end wall, so that the hinge slides beneath the pivot axis to pivot the flap between the open position and the closed position.

* * * * *